US008516631B1

(12) United States Patent
Conley

(10) Patent No.: US 8,516,631 B1
(45) Date of Patent: Aug. 27, 2013

(54) TEACHING BED LINENS

(76) Inventor: Brooke Conley, Westerly, RI (US)

( * ) Notice: Subject to any disclaimer, the term of this patent is extended or adjusted under 35 U.S.C. 154(b) by 255 days.

(21) Appl. No.: 12/858,734

(22) Filed: Aug. 18, 2010

Related U.S. Application Data

(60) Provisional application No. 61/318,904, filed on Mar. 30, 2010, provisional application No. 61/274,856, filed on Aug. 21, 2009.

(51) Int. Cl.
*A47G 9/02* (2006.01)

(52) U.S. Cl.
USPC ..... 5/482; 5/500; 5/502; 5/490

(58) Field of Classification Search
USPC ..... 5/485, 482, 490, 497, 499, 500, 502
See application file for complete search history.

(56) References Cited

U.S. PATENT DOCUMENTS

| | | | | | |
|---|---|---|---|---|---|
| 3,613,133 | A * | 10/1971 | Isola et al. | ..... | 5/502 |
| 4,442,558 | A * | 4/1984 | Alexander | ..... | 5/494 |
| 4,875,245 | A * | 10/1989 | Isola | ..... | 5/482 |
| 4,934,939 | A * | 6/1990 | Bonneville | ..... | 434/247 |
| 5,208,926 | A * | 5/1993 | Stackhouse | ..... | 5/482 |
| 6,230,341 | B1 * | 5/2001 | Dudley | ..... | 5/482 |

* cited by examiner

*Primary Examiner* — Robert G Santos
(74) *Attorney, Agent, or Firm* — Salter & Michaelson

(57) ABSTRACT

A bedding system for use with a bed that includes at least a base support member. The bedding system includes a base layer of bedding material that is for support on the base support member; an overlying piece of bedding material for positioning on the base layer; first indicia on the base layer; second indicia on the overlying piece; with said first and second indicia defining, when placed adjacent to each other, a predetermined matching contour that indicates an alignment between the base layer and the overlying layer.

7 Claims, 7 Drawing Sheets

TEACHING BED LINENS

RELATED CASES

Priority for this application is hereby claimed under 35 U.S.C. §119(e) to commonly owned and co-pending U.S. Provisional Patent Application No. 61/274,856 filed on Aug. 21, 2009 and U.S. Provisional Patent Application No. 61/318,904 filed on Mar. 30, 2010 and each of which is incorporated by reference herein in its entirety.

BRIEF DESCRIPTION OF THE INVENTION

This invention relates to a bedding system that is intended to make it easier for a person (especially a child) to make a bed correctly and additionally having storage areas that make it easier for the person to organize personal articles. An additional benefit is that the bed is more comfortable to sleep in because the bed linens do not get twisted or bunched up.

BACKGROUND OF THE INVENTION

In our lifetime, getting people (especially children) to make their beds can be a trying ordeal. This can be attributed largely to the fact that it can be both difficult to get the bed made correctly because of alignment problems and also because the task is not considered fun.

Further, organization of the area around a person's bed can be problematic. Children like to have personal articles such as favorite toys, books, games and so forth within easy reach of their bed. This plethora of articles can make for a messy area around the bed and can leave the child and parents feeling less than happy with the result.

Bedding alignment issues have been attempted to be solved in the prior art by a variety of measures such as alignment buttons at the bottom of the bed. However, this is not a complete solution because the buttons at the bottom of the bed do not necessarily assure alignment of sheets, blankets and comforters at the head of the bed.

As for the problem of organizing the bed area, this has been attempted to be solved in the prior art by inventions such as pockets attached to various bedding materials such as pillow cases, comforters, blankets and so forth. This solution is not optimum because the pockets and storage spaces on the bedding material can make the bedding more complicated both to manufacture in the first place and can be uncomfortable for a user while trying to sleep.

It would be a significant improvement in the art and technology to enable beds to be made more easily and to have bedding materials that make organization of the bedroom better and neater. Specifically, an improvement in the art would be if there were technology that allowed alignment of both the foot area of the bed and the head of the bed. More specifically, an improvement in the art would be if storage areas for personal items could be included as part of the total bedding system, but that is not necessarily an integral part of the standard sheets, blankets or comforters.

SUMMARY OF THE INVENTION

An embodiment of the invention is a bedding system including anchor systems (e.g., buttons) at the bottom of the bed attached to the fitted sheet and receiving means (e.g., holes) to receive the fitted sheet anchor through the bedding materials above the fitted sheet (e.g., flat sheet, blankets and/or comforters).

Another embodiment of the invention includes an additional alignment means for the bedding materials at the head of the bed. This additional alignment means comprises markings or figures that can be aligned to make sure that the head portion of the bed (where it is not convenient to include additional anchors) is aligned as well as the foot portion of the bed in order to have a complete well made and attractive bed. Alignment graphics (markings, figures or appliques) may also be provided as well (i) on the pillowcase, blanket or comforter (layers), at the head end of these materials, and (ii) and also at or throughout the bottom and middle portions of the respective layers. Thus, alignment graphics permeate the design both at the head and at the foot of the bed.

Yet another embodiment of the invention includes a "saddle bag" type storage system which is not an integral part of the sheets, blankets or comforter, but instead includes at least two storage areas (e.g., pockets) which are separated by a length of material that is slightly longer than the width of the bed. This saddle bag storage area is intended to be layered and fit underneath the mattress and on top of the box spring [between the two items] so that the material between the two storage areas is underneath the mattress, not visible and not uncomfortable for someone sleeping on the bed.

Finally, another embodiment of the invention includes where function, design and comfort would indicate, various storage areas and pockets included in the sham and other areas.

In accordance with the present invention there is provided a bedding system for use with a bed that includes at least a base support member, said bedding system comprising: a base layer of bedding material that is for support on the base support member; an overlying piece of bedding material for positioning on the base layer; first indicia on the base layer; second indicia on the overlying piece; with said first and second indicia defining, when placed adjacent to each other, a predetermined matching contour that indicates an alignment between the base layer and the overlying layer.

In accordance with other aspects of the present invention the base layer includes a fitted sheet; the overlying piece includes at least one of a flat sheet, a blanket and a comforter; the indicia includes at least one of a figure, graphic, geometric shape, illustration, and puzzle; the first indicia is on the top side of the base layer; the second indicia is on the top side of the overlying piece or on the bottom side of the overlying piece; the overlying piece includes an overlying sheet that is folded back so that at least a part of the second indicia can be aligned with at least a part of the first indicia; the overlying piece comprises a pillowcase or pillow cover.

In accordance with still another version of the invention there is provided a bedding system for use with a bed that includes at least a base support member, said bedding system comprising: a base layer of bedding material that is for support on the base support member; an overlying piece of bedding material for positioning on the base layer; and attachment means connected between the base layer and the overlying piece to enable alignment between the base layer and the overlying piece.

In accordance with still other aspects of the present invention the base layer includes a fitted sheet; the overlying layer includes at least one of a flat sheet, a blanket and a comforter; the attachment means comprises an anchor member on one of said layers and an opening on the other of said layers; the anchor member is selected from a strap, rope, string or other flexible member; the overlying piece comprises a pillowcase having attachment loops; the pillowcase has a large opening at one end thereof and a small opening at the other end thereof to assist in inserting a pillow into the pillowcase; the base layer comprises a fitted sheet having at least one attachment anchor, and the overlying piece comprises a pillowcase having at least one attachment loop for engagement with the anchor.

In accordance with the present invention there is also provided a bedding system for use with a bed that includes at least a box spring and mattress, said bedding system comprising: a material strip that is meant to be disposed between the box spring and mattress; said material strip extending in a direction transverse to the length of the bed; at least one storage member attached with the material strip and for the storage of items therein; said storage member comprising a storage area that is contiguous with the material strip and that is adapted to hang beside the box spring when positioned; wherein the storage area has one or more pockets; and preferably including opposite storage areas on either side of the bed and both contiguous with the material strip.

BRIEF DESCRIPTION OF THE DRAWINGS

The present invention is illustrated by way of example and not limited by the accompanying figures, in which like references indicate similar elements and in which.

DETAILED DESCRIPTION

Figure 1A:
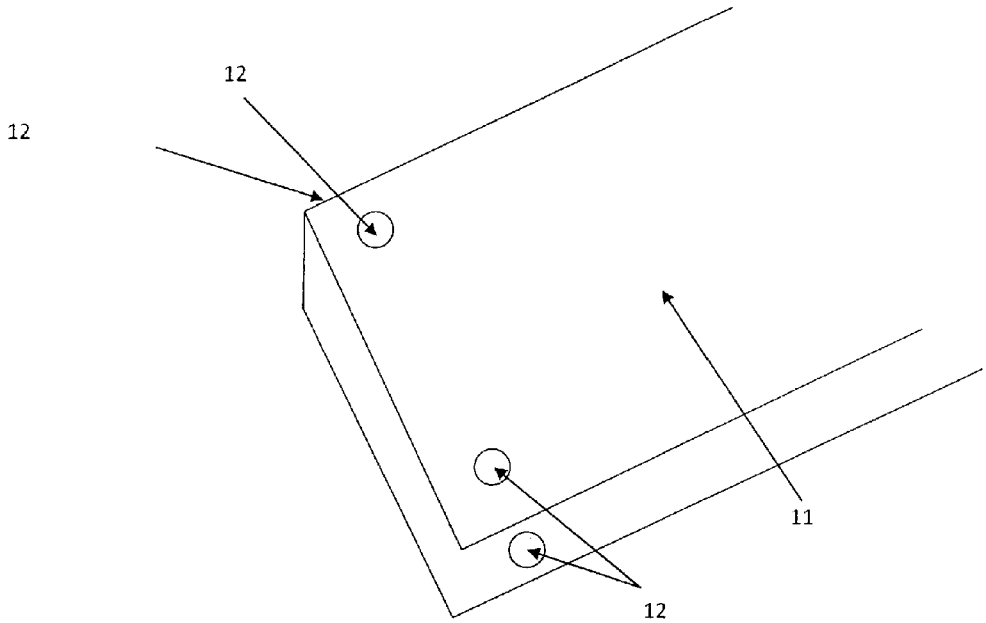
FIG. 1*a* illustrates a top view of the bottom portion of a fitted sheet according to certain embodiments of the invention.

Referring to FIG. 1*a*, there is illustrated a version of the invention showing the bottom portion of fitted bottom sheet 11 and including anchor means 12. Anchor means 12 can be any of a variety of attaching mechanisms such as a standard button or a strap, rope, string or other flexible member with some type of oversized section to assure that the strap does not easily come back through the holes in the covering sheets (e.g., a knot).

Anchor means 12 must be long enough that it can be threaded through the various top covers, such as the flat top sheet 21 shown in FIG. 2. Typically this means that anchor means 12 is somewhere between 0.5 inches and 6 inches long. The alignment could be done with one anchor means in the center of the bottom of fitted sheet 11, but in a preferred embodiment, there would be at least two different anchor means 12 positioned near the bottom of fitted sheet 11 and spaced far enough apart that alignment of the covering sheets is optimized. It is possible that for maximum alignment there could be as many as 4 or even more anchor means 12 but additional anchor means can complicate the bed making process. Anchor means 12 can also or alternatively be placed on the side portion of fitted sheet 11 (as shown in FIG. 1) or possibly the top of fitted sheet 11 (not expressly shown) or both (not expressly shown).

Figure 1B:
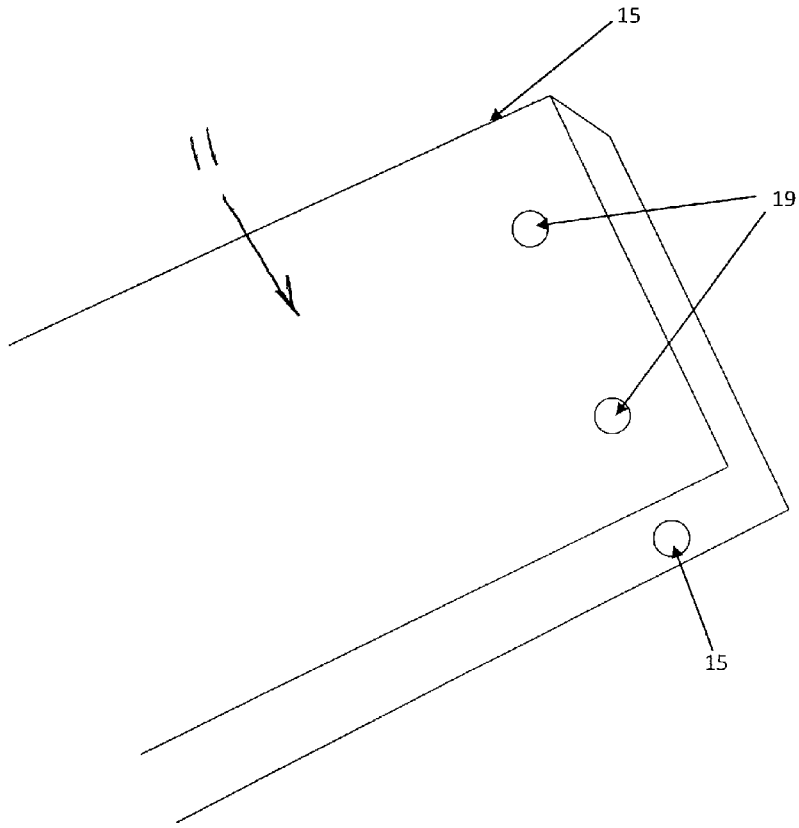
FIG. 1*b* illustrates a top view of the top portion of a fitted sheet according to certain embodiments of the invention.
Figure 2A:
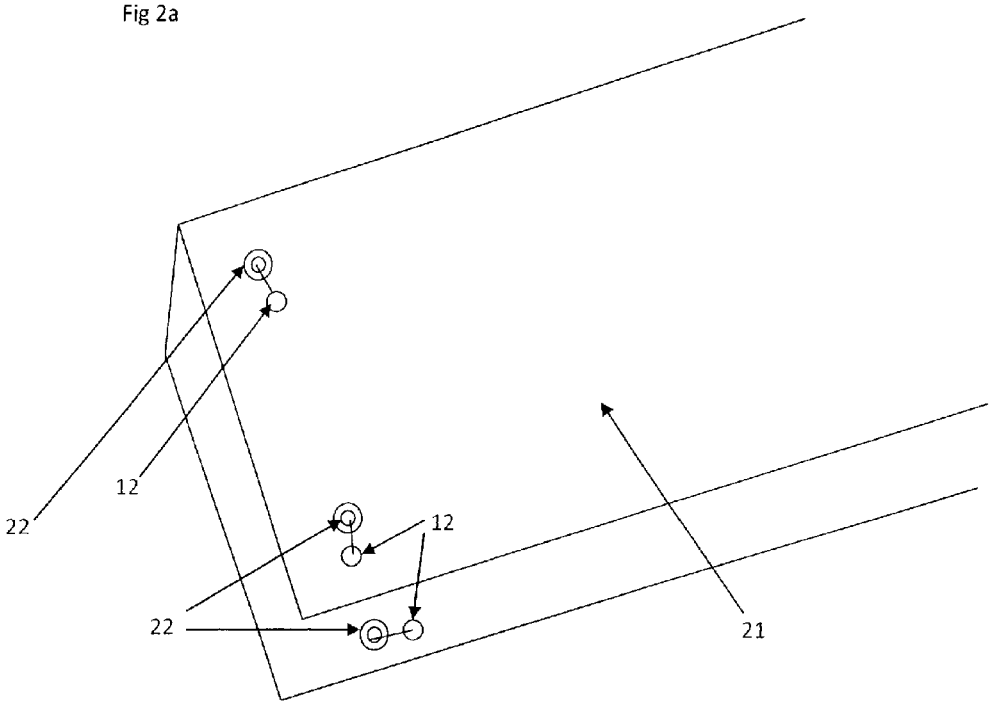
FIG. 2*a* illustrates a top view of the bottom portion of a flat sheet, blanket or comforter which sits over the fitted sheet of FIG. 1.

Referring to FIG. 2*a*, it shows a version of the invention showing flat sheet 21 with openings 22. Openings 22 are sized and placed such that they can accommodate anchor means 12 from fitted sheet 11 (see FIG. 1) which is below the top sheet 21. FIG. 2 shows anchor means 12 protruding through openings 22. The act of putting anchor means 12 through openings 22 assures that flat sheet 21 is aligned at least at the bottom with fitted sheet 11. Although FIG. 2 shows flat sheet 21 it is also intended to represent other potential coverings over fitted sheet 11 such as a blanket, comforter and so forth. In fact the invention is intended such that anchor means 12 can be threaded through multiple coverings such as the flat sheet, blanket and/or a comforter. Accordingly, if in FIG. 2, covering 21 is a comforter, then one could expect that underneath comforter 21 there is a flat sheet and/or blanket with openings corresponding to openings 22 and through which anchor means 12 has also been threaded through.

Figure 2B:
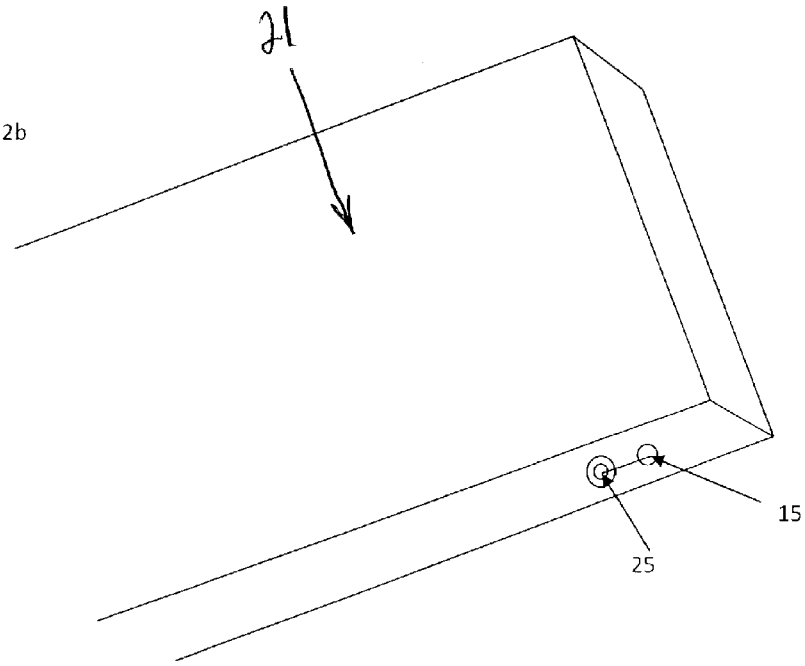
FIG. 2*b* illustrates a top view of the top portion of a flat sheet, blanket or comforter which fits over the portion of the fitted sheet in FIG. 1B

While anchor means 12 of FIGS. 1*a* and 2*a* assure alignment at the bottom of the bedding system, it does not assure alignment at the top of the bed. FIGS. 1*b* and 2*b* illustrates an embodiment where anchors 15, 19 of the top portion fitted sheet can be inserted into means (openings) in the top portion of the top sheet, blanket and comforter. FIG. 1*a* shows two top side anchors 19 and respective opposed side anchors 15. FIG. 2*b* shows an illustration of one of the side anchors 15 extending through the opening 25 in the top flat sheet 21. Should the embodiments detailed below in FIGS. 3A, 3B and 3C be utilized, the anchors and means illustrated by FIGS. 1*b* and 2*b* will not be necessary for alignment, but an optional device for children to use at their discretion to keep their bed tidy after it is made. Use of this anchor means as a discretionary component, rather than the primary means of aligning the top portion of the bed, is optional as this anchor means may be difficult for some (children in particular) as it adds an extra step and the placement of the bed against a wall would make daily use difficult.

Figure 3A:
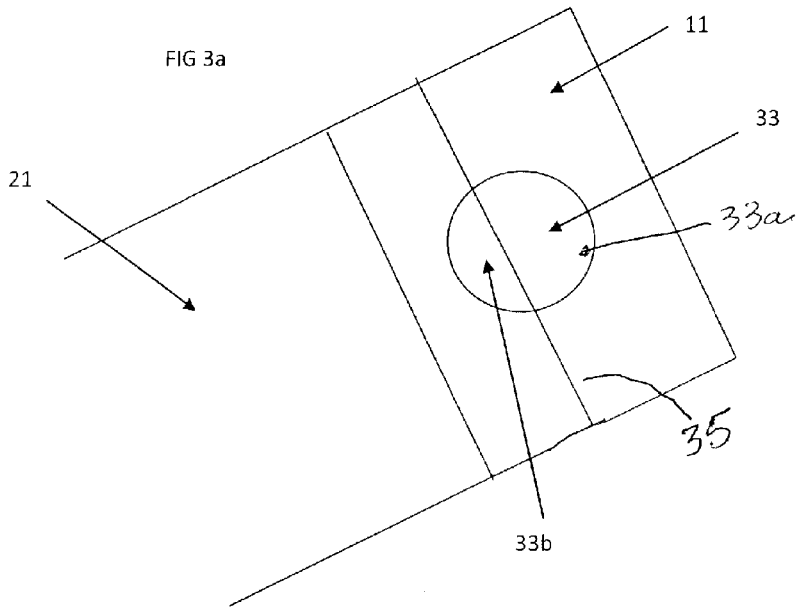
FIG. 3*a* illustrates a top view of the head portion (top portion) of the top alignment system of the invention using matching markings or figures on the fitted sheet and pillow case or pillow cover, or the fitted sheet and flat sheet.

FIG. 3*a* shows a preferred alignment system for the top of a bedding system that does not require any anchoring means, such as previously illustrated. The alignment for the top of the bedding system comprises visual marking or figures on both bottom fitted sheet 11 and top flat sheet 21 (or blanket or comforter). In FIG. 3*a* the overall marking 33 is a circle that is to be completed by the person making the bed, usually in teaching a child how to make a neat bed. The circle 33 is comprised of partial circles 33*a*, 33*b* on respective sheet 11, 21. These partial circles are illustrated on the top side of sheets 11, 21 but could also appear on the sides of these sheets. The partial circle 33*a* could actually be a full circle but in FIG. 3*a* one can only see the top half of circle 33*a* since the bottom half is covered by the folded flat sheet 21. Similarly, the partial circle 33*b* could be a full circle but in FIG. 3*a* the top sheet has been folded over at 35 showing only the partial circle 33*b* which mates with the circle 33*a* to provide proper alignment of the upper sheet with the bottom sheet. In order to align the upper section of flat sheet 21 with fitted sheet 11, all a child needs to do is match circle 33*b* on the bottom side of flat sheet 21 (folded over at 35) to circle 33*a* on the top side of fitted sheet 11 (alignment at the head of any fitted sheet is essentially automatic since they conform to the shape of the bed). Because often flat sheets are folded over at the top of the bed (see the fold 35 in FIG. 3), circle 33*b* is on the underside of flat sheet 21.

In connection with FIG. 3, this alignment of the top (or exposed) part of circle 33*a* to the bottom part of circle 33*b* to form a complete circle assures alignment of flat sheet 21 relative to the fitted sheet 11. The alignment markings or figures can be any of a vast range of visual clues. It could be as simple as a line or marking but is most preferably something that children will enjoy matching together (like parts of a puzzle in particular would be of interest to a child). One can imagine licensed figures such as Cinderella, Sponge Bob Square Pants and so forth as the matching markings. In such a case a child would know that they have aligned the top portion of flat sheet 21 when they folded over the top portion of flat sheet 21 and have completed an entire picture of Cinderella (for example) by using the top half of Cinderella from fitted sheet 11 and the bottom half of Cinderella from flat sheet 21. Doing alignment in this way assures that, not only is flat sheet 21 aligned correctly side to side, but also that the child has folded over flat sheet 21 the correct amount so that the vertical alignment and folding over of the flat sheet is correct. The result is a perfect bed each and every time and a child who is having fun completing a picture, graphic or puzzle. FIG. 3 shows flat sheet 21 but this marking based alignment system is also usable for blankets and/or comforters in the same manner.

Figure 3B:
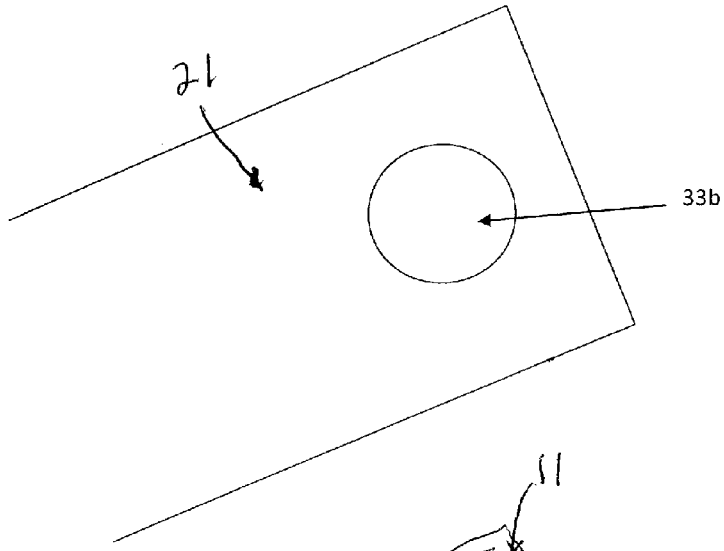
FIG. 3*b* illustrates a top view of the head portion (top portion) of an alternative embodiment of the top alignment system of the invention using matching markings or figures on the fitted sheet and pillowcase or pillow cover, or the fitted sheet and flat sheet.

An alternative embodiment may use a top sheet in which the circle or partial circle is disposed on the upper surface thereof rather than on the underside as show in FIG. 3*a*. In that instance the top sheet is not meant to be folded down, but instead the circle 33*a* (or a part thereof) on the upper surface of the top sheet is to be aligned with the fitted sheet circle 33*b* (or a part thereof) on the upper surface of the fitted sheet. Again other graphics can be used instead of a circle, but the circle is illustrated herein in order to simplify the description. FIG. 3*b* shows an alignment method in which the top sheet, blanket and/or comforter is placed directly over the fitted sheet or pillowcase and the upper sheet is not folded, but instead the overlying sheet (flat sheet, comforter or blanket) is placed directly on top of the base or fitted sheet. FIG. 3*b* shows only the circle 33*b* associated with the over material. The circle 33*a* would be underneath on the fitted sheet or pillowcase. The alignment would be made as the top layer is laid over the under-layer.

In both FIGS. 3*a* and 3*b* markings may be applied, printed or made through some other method. These markings can occur many times throughout the set on the pillowcase, pillow flap, top sheet, blanket and or comforter, in whatever way is deemed most intuitive to the child and pleasing to the eye.

Figure 3C:
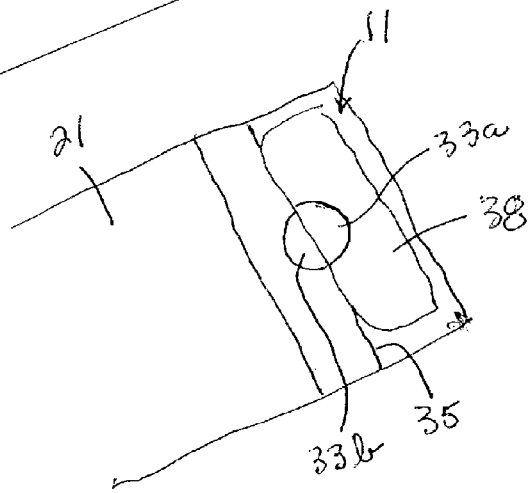
FIG. 3*c* illustrates the arrangement of FIG. 3*a* but with the use of a pillowcase.

Reference is now made to FIG. 3*c* which shows, instead of an alignment with a bottom sheet, an alignment between the top sheet 21 and the pillowcase 38. In FIG. 3*c* note the fold at 35; the aligned circles 33*a* and 33*b*; the circle 33*a* on the pillowcase 38; and the circle 33*b* on the sheet 21.

Figure 4A:
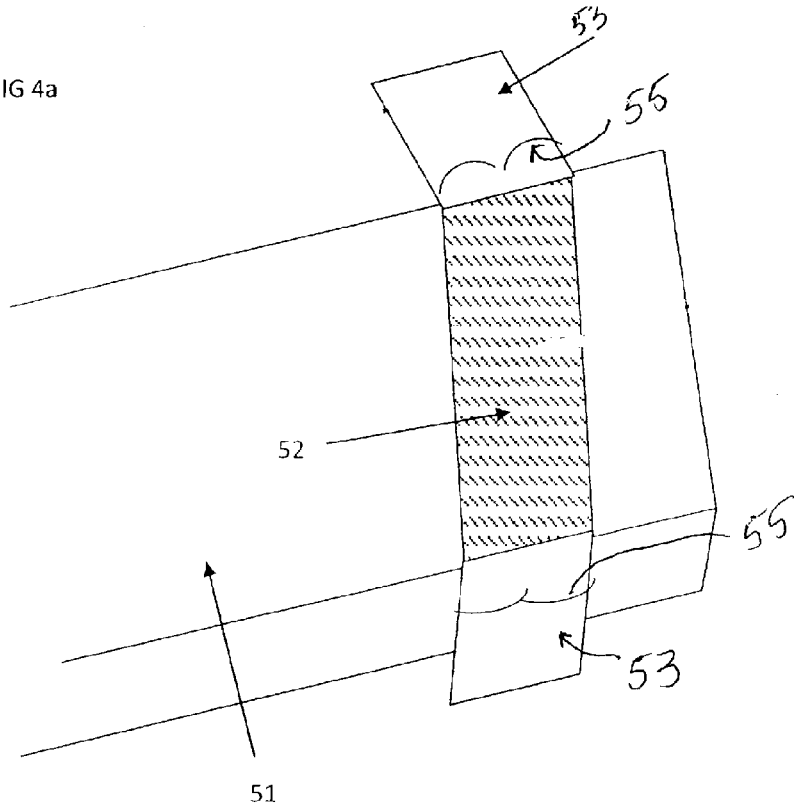
FIG. 4*a* illustrates a top view of the "saddle bag" storage system on top of the box spring of the bed and before the mattress is placed over the system.

FIG. 4 illustrates the "saddle bag" storage system of the bedding system of the present invention. FIG. 4 shows the bed with box spring 51 without any mattress on top. Placed over box spring 51 is attachment means 52 which connect storage areas 53 (attachment means 52 and storage means 53 can be integral parts of the apparatus). Attachment means 52 has a length which is roughly equivalent to the width of the bed such that when the mattress is placed over box spring 51, the storage areas 53 stick out from between box spring 51 and the mattress. Attachment means 52 may include a means such as buttons or snaps to adjust the length to accommodate different width beds. Attachment means 52 can be any of a large number of different materials and shapes. It could be a rectangular fabric, rope, strap, or any other way of connecting storage areas 53. Storage areas 53 can also be any of a large number of different ways to store materials. They could be pockets, pouches, boxes, tubes and so forth. Storage areas 53 may be sized to hold things such as a child's favorite books, toys and so forth. In another embodiment of the invention, the saddle bag storage system can be placed on top of the mattress as opposed to under the mattress. In this embodiment, attachment means 53 must be comfortable enough to be slept on, and thus relatively thin. FIG. 4 illustrates a series of pockets 55 on both of the respective storage areas 53. Areas 52 and 53 may be of the same material and the areas 53 are meant to fall by gravity on either side of the box spring.

Figure 4B:
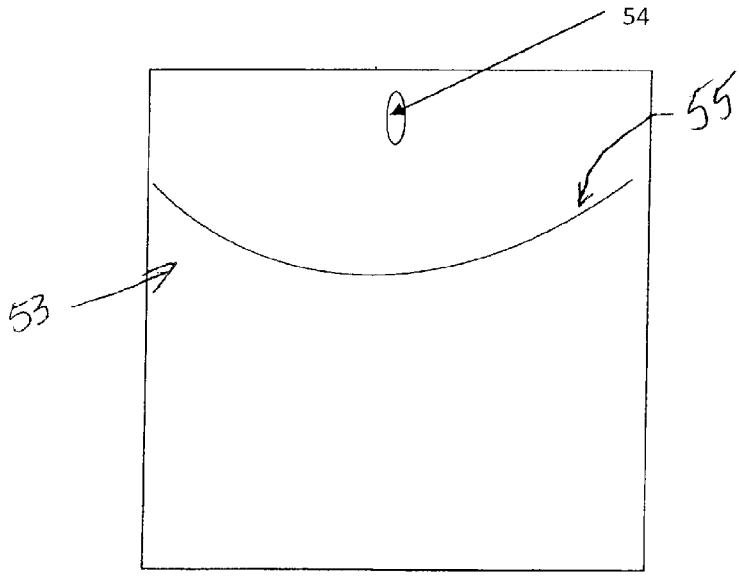
FIG. 4*b* illustrates an alternative embodiment of the saddle bag storage system that does not include piece 52.

FIG. 4*b* illustrates an embodiment of the saddle bag system that does not include the middle piece 52, but rather includes separate pads 53 each with one or more openings 54, to accommodate anchor means 12 and 15 as illustrated in FIGS. 1*a* and 1*b*. In this way the pads 53 can hang from opposite sides of the bed and be supported by anchors attached with, for example, the bottom fitted sheet.

Figure 5:
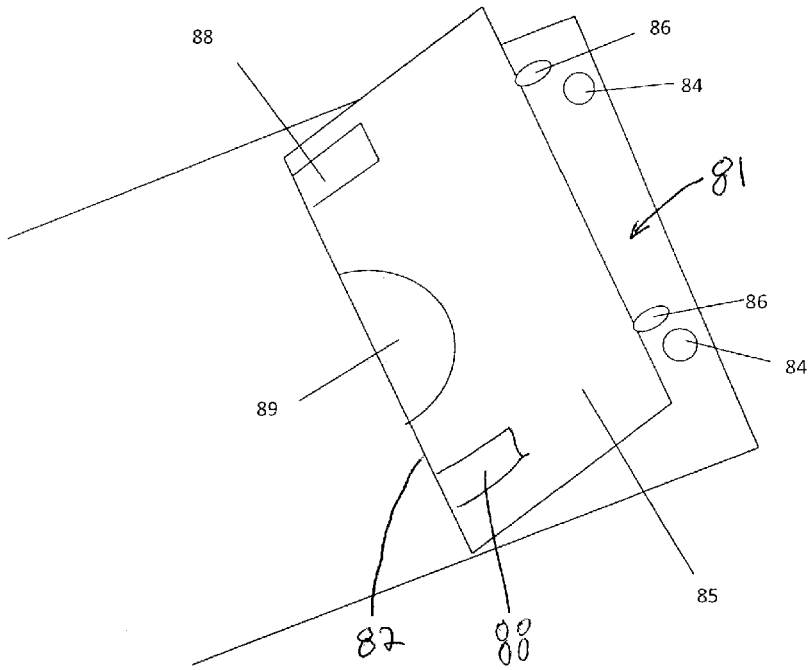
FIG. 5 illustrates a top view of a fitted sheet that in an alternative embodiment also includes a pillow cover section which may include storage areas.

In an alternative embodiment of the fitted sheet of the present invention, FIG. 5 shows fitted sheet 81 with pillow cover 85. Pillow cover 85 is a flap integral with fitted sheet 81, and joined thereto along join line 82. Pillow cover 85 may include storage areas or pockets 88 and is provided with an alignment marking 89. The illustrated marking semi-circle 89 would be for alignment with a matching semi-circle of the under-sheet such as shown in FIG. 3*a*. Storage areas such as illustrated by pockets 88 may be included on any portion of the bedcovers to improve design or functionality. Pillow cover 85 may also include loop openings 86 which are sized and located to accept anchor means 84 at the top portion of fitted sheet 81. The anchors means may be cords of a sufficient length to engage with the loops 86.

Figure 6A:
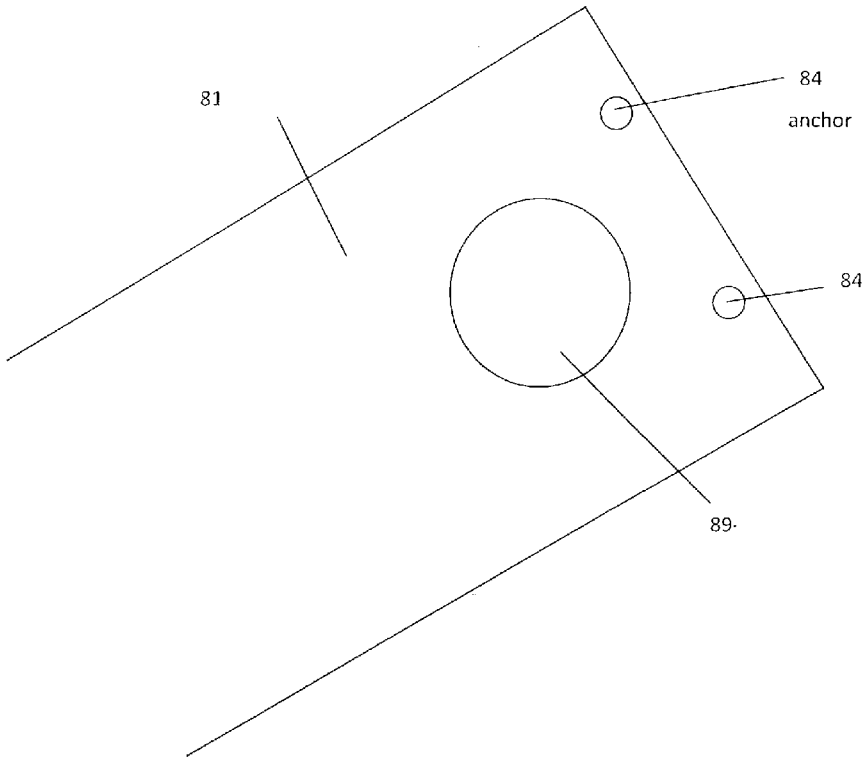
FIG. 6*a* illustrates an alternate embodiment showing just the fitted sheet.
Figure 6B:
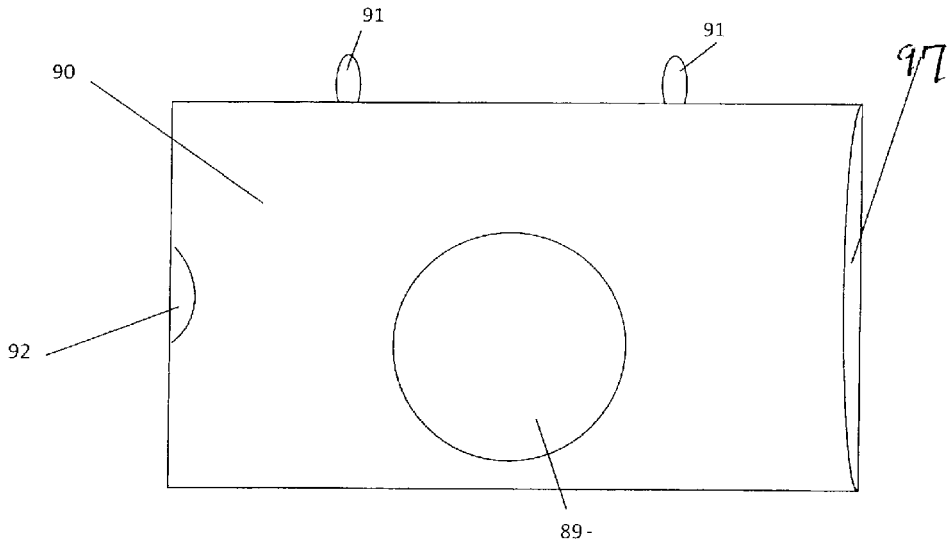
FIG. 6*b* illustrates the pillow case that is associated with the fitted sheet of FIG. 6*a*.
Figure 7:
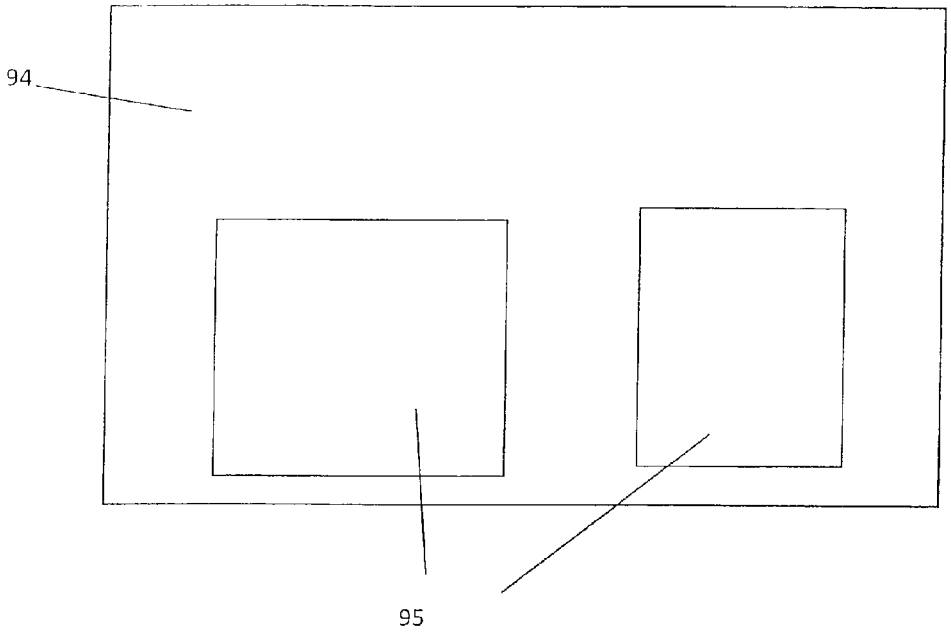
FIG. 7 illustrates a pillow sham that may be used with the invention.

Still another embodiment of the present invention is illustrated in FIGS. 6*a* and 6*b*. FIG. 6*a* illustrates an alternate embodiment showing just the fitted sheet 81, while FIG. 6*b* illustrates the pillowcase 90 that is associated with the fitted sheet 81 of FIG. 6*a*. The fitted sheet 81 is shown in FIG. 6*a* as having anchors 84. Two such anchors 84 are shown in FIG. 6*a*, however, more than two may be used. Each of the anchors 84 may be in the form of a button or other fastener means. As illustrated in FIG. 6*b* the pillowcase 90 is provided with a like number of hooks or loops 91 attached to the pillowcase and corresponding to the number of anchors 84 on the fitted sheet 81. Each button 84 is engaged with a corresponding hook or loop 91. In addition to the large opening 97 at one end of the pillowcase for receiving the pillow (not shown), there may also be provided a small opening 92 shown in FIG. 6*b* at the opposite end of the pillowcase 90. Alignment cues 89, may also be on the pillowcase and fitted sheet. The opening 92 enables a small child to more easily pull the pillow through and into the pillowcase 90. In FIGS. 6*a* and 6*b* the circles 89 are located so that alignment of the bedding is possible as previously described. FIG. 7 illustrates a pillow sham 94 having one or more storage pockets 95. The sham 94 can be used with the bed set for additional comfort and convenience.

In the foregoing specification, the invention has been described with reference to specific embodiments. However, one of ordinary skill in the art appreciates that various modifications and changes can be made without departing from the scope of the present invention.

What is claimed is:

1. A bedding system for use with a bed that includes at least a base support member, said bedding system comprising:

a base layer of bedding material that is for support on the base support member;

said base layer including a sheet;

an overlying piece of bedding material for positioning on the base layer;

said overlying piece includes at least one of a sheet, a blanket and a comforter having top, bottom and side edges;

first indicia disposed on a top side of the base layer;

second indicia disposed on a bottom side of the overlying piece and spaced apart from the top, bottom and side edges;

both the first and second indicia including a line marking;

said first and second indicia respective line markings defining, when placed adjacent to each other, a predetermined matching contour that indicates a side to side alignment between the base layer and the overlying layer;

wherein the matching contour comprises a closed and full geometric shape;

said overlying piece having an unfolded state wherein the second indicia is hidden from view and a folded state wherein the second indicia is in view;

wherein, when the overlying piece is in the folded state, the matching contour provides, not only the side to side alignment between the base layer and the overlying piece, but also vertical alignment of the overlying piece so that the closed full geometric shape is completed.

2. The bedding system of claim 1 wherein the geometric shape is a circle.

3. The bedding system of claim 2 wherein the first and second indicia together form a perfect circle when all line markings are in line.

4. The bedding system of claim 1 including a pillowcase or pillow cover.

5. A bedding system for use with a bed that includes at least a base support member, said bedding system comprising:

a base layer of bedding material that is for support on the base support member;

said base layer including a sheet;

an overlying piece of bedding material for positioning on the base layer;

said overlying piece includes at least one of a sheet, a blanket and a comforter having top, bottom and side edges;

a pillow case or pillow cover;

first indicia disposed on the pillow case or pillow cover;

second indicia disposed on a bottom side of the overlying piece and spaced apart from the top, bottom and side edges;

both the first and second indicia including a line marking;

said first and second indicia defining respective line markings, when placed adjacent to each other, a predetermined matching contour that indicates a side to side alignment between the pillow case or pillow cover and the overlying layer;

wherein the matching contour comprises a closed and full geometric shape;

said overlying piece having an unfolded state wherein the second indicia is hidden from view and a folded state wherein the second indicia is in view;

wherein, when the overlying piece is in the folded state, the matching contour provides, not only the side to side alignment between the base layer and the overlying piece, but also vertical alignment of the overlying piece so that the closed full geometric shape is completed.

6. The bedding system of claim 5 wherein the geometric shape is a circle.

7. The bedding system of claim 6 wherein the first and second indicia together from a perfect circle when all line markings are in line.

* * * * *